phase, the critical velocity for a particular set of parameters will be the lowest possible.

FIG. 2 is a graph illustrating advantage of the cascade. The ordinate is a non-dimensional ratio of the critical velocity for a cascade V(s/c) where adjacent airfoils oscillate 180° out of phase to the critical velocity for a single airfoil V(∞). The parameter s/c defines the spacing of airfoils arranged in a cascade where s is the distance between adjacent airfoils and c is the chord (see FIG. 4). This parameter forms the abscissa in FIG. 2. For a particular set of parameters, it can be seen that where s/c is about $\frac{1}{3}$, the critical velocity for a cascade is about $\frac{1}{2}$ that needed to produce flutter in the case of a single airfoil. Accordingly by using a cascade for the absorption of energy due to the flutter phenomenon, flutter can be achieved at much lower velocities than with a single airfoil. In fact, by controlling the various parameters as will be explained hereinafter, the critical velocity needed to induce harmonic oscillations can be as low as 1 m.p.h.

FIG. 3 is a graph illustrating the advantages of incorporating a utility device such as an electrical network into an oscillating cascade. The ordinate is a non-dimensional flutter speed ($V/\omega_\alpha \cdot b$) where V is the velocity, $\omega_\alpha$ is the natural vibration frequency associated with pure pitch when V=0 and b is the airfoil semi-chord. The abscissa is the ratio of $\omega_h$ to $\omega_\alpha$, the natural frequency associated with pure plunge when V=0. The region below each curve defines the region of stability where the aerodynamic energy $E_A$ is less than the mechanical energy $E_M$. For a given set of values $\omega_h$ and $\omega_\alpha$, the critical velocity $V_c$ can be derived. Above each curve, which represents the critical velocity $V_c$, $E_A$ is greater than $E_M$ and, accordingly, defines a region of instability. The lower curve represents the critical velocity for a single airfoil while the upper curve represents the critical velocity where a utility device is incorporated into the system. This graph then illustrates that by adding a utility device, the aerodynamic energy which would otherwise cause the system to enter the unstable region is instead absorbed by the utility device while the system remains in the stable region. In the case of a cascade, since critical velocity is lower for a particular set of parameters, the associated curves will, of course, be lower than those shown in FIG. 3 for the single airfoil.

FIGS. 4 and 5 illustrate the harmonic oscillations which result when a cascade of airfoils is subjected to fluid flow at critical velocity, i.e. at flutter. In FIG. 4, the airfoils are at zero angle of attack prior to being disturbed. Even though the wind velocity is at the critical level, there is no movement of the airfoils due to their symmetrical contour. However, as soon as the system is disturbed by moving at least one of the airfoils, the flow field has the effect of coupling adjacent airfoils so that they begin to oscillate approximately 180° out of phase as shown schematically in FIG. 5. This oscillatory movement, which occurs at critical velocity, was first observed during studies of the adverse effects of flutter on rotating compressor blades.

Turning to FIG. 6, there is shown a first embodiment for mounting the airfoils of the present invention within the support structure 16 to permit the substantially 180° out of phase oscillations produced at flutter.

In order to facilitate understanding of the invention, only four of the ten airfoils shown in FIG. 1 are depicted in FIG. 6, namely, airfoils $\mathbf{18_4}$–$\mathbf{18_7}$ although all of the airfoils will be referred to hereinafter. As shown, the airfoils are arranged to define two subsystems, the odd numbered airfoils $\mathbf{18_1}$, $\mathbf{18_3}$, $\mathbf{18_5}$, $\mathbf{18_7}$ and $\mathbf{18_9}$ defining a first subsystem and the even numbered airfoils $\mathbf{18_2}$, $\mathbf{18_4}$, $\mathbf{18_6}$, $\mathbf{18_8}$ and $\mathbf{18_{10}}$ defining a second subsystem. The airfoils of each subsystem are interconnected to move in phase while each airfoil has at least two degrees of freedom since at least two degrees of freedom are required to induce flutter oscillations.

For the first subsystem, a pair of horizontal bars **20*a*, 20*b* are mounted to the bottom wall 22 of the support structure by springs 23*a*, 23*b*, while a second pair of horizontal bars 24*a*, 24*b* are mounted by springs 25*a*, 25*b* to the upper wall 26 of support structure 16. A pair of rods 28*a*, 28*b* extend between bars 20*a* and 24*a* and 20*b* and 24*b*, respectively, and are pivotally connected at 29*a*, 29*b* to the leading edge of each odd numbered airfoil. A similar pair of rods 30*a*, 30*b* extend between bars 20*a*, 24*a* and 20*b*, 24*b* respectively, and are pivotally connected at 31*a*, 31*b* to the trailing edge of each odd numbered airfoil. Rods 28*a*, 28*b*, 30*a* and 30*b* are connected to be slidable along their associated horizontal bars in order to accommodate limited pitching movement of the interconnected odd numbered airfoils without binding. Stops 32*a*, 32*b*** are also provided to limit the amount of movement of this subsystem. Accordingly, with this mounting arrangement, a limited amount of pitch and plunge is permitted for the airfoils of the first subsystem.

The second subsystem is connected to the support structure 16 in a similar fashion. Thus, horizontal bars **34*a*, 34*b* and 36*a*, 36*b* are supported respectively by springs 37*a*, 37*b*, 38*a*, 38*b* and are interconnected by rods 40*a*, 40*b* and 42*a*, 42*b*, which are pivotally connected at 43*a*, 43*b* and 44*a*, 44*b* to the leading and trailing edges respectively of the even numbered airfoils. Rods 43*a*, 43*b*, 44*a*, 44*b* are connected to their associated horizontal bars to permit limited pitching movement. Finally, stops 45*a*, 45*b*** are also provided to limit the movement of the even numbered airfoils.

From the foregoing, it will be apparent that the two subsystems are free to oscillate in pitch and plunge relative to each other and that when the energy converting device 10 is subjected to the wind at a critical velocity, the adjacent airfoils will oscillate approximately 180° out of phase as shown in FIG. 5. Thus the critical velocity will be the lowest possible for a particular set of parameters.

Since it is necessary to disturb the airfoils in order to achieve the desired harmonic oscillations, at least one mechanical oscillator is provided for one of the subsystems. In the embodiment of FIG. 6, oscillators 46 are provided for each subsystem with an oscillator at the forward and rearward end of each horizontal bar **20*a*, 20*b*, 34*a*, 34*b***. The forward and rearward oscillators for each subsystem are operated 180° out of phase. Similarly the corresponding oscillators for each subsystem are also oscillated 180° out of phase. In addition to providing the initial disturbance, operation of these oscillators maintains and enhances the oscillatory movement. Thus if the wind should die down to a velocity which is too low for the control system, which will be explained below, to maintain the system at critical velocity, the mechanical oscillators will keep the airfoils oscillating, until the velocity increases sufficiently to reestablish flow at critical velocity.

With the present invention, the natural velocity of the wind is used as the critical velocity. Accordingly, in order for this velocity to induce flutter oscillations, one

PUMPING EJECTOR

BACKGROUND OF THE INVENTION

The present invention relates to a pumping ejector with a nozzle which uses pressurised steam as the entrainment fluid for another fluid to be pumped.

Numerous constructions of apparatus of this type are known, particularly with reference to their use for conveying dangerous and in particular radioactive fluids where, unlike pumps, said ejectors have no rotating parts and are therefore particularly suitable because they do not require the fitting of special sealing means of the type which have to be provided between the impellers of pumps and their drive motors.

In certain nuclear installations ejectors have been used whose construction and arrangement are such that it is easy to disassemble the nozzle for repair and maintenance, whereby said disassembly can take place without any danger of radioactive contamination of the environment outside a protective cell which in its wall carries the exchanger body. In particular such an ejector has been described and claimed in French Pat. No. 2,122,640 in the name of the commissariat à l'Energie Atomique.

In the case of such ejectors two constructional solutions can be envisaged, depending on whether the steam is supplied inside or outside the protective cell, the ejector body being in all cases carried by a supporting block fitted in the wall of the cell or anchored in the concrete which generally constitutes the latter. However, due to the dangerous nature of the fluids conveyed it is generally difficult in constructions of this type to gain access to the pipes connected to the ejector body upstream and downstream of the nozzle fitted in said body and by means of which the acceleration of the pumping steam is obtained. Due to the suspended particles contained in the pumped fluid or its inherent viscosity in many cases said fluid may obstruct and even totally block the pipes, thus making the ejector unusable.

BRIEF SUMMARY OF THE INVENTION

The present invention relates to a pumping ejector which obviates the disadvantages of the known solutions by permitting an easy cleaning or unblocking of the discharge pipes for the pumped fluid without it being necessary to have direct access thereto within the protective cell.

The object of the invention is therefore a pumping ejector comprising a fixed tubular ejector body traversing the wall of a protective cell, said body having in its part which projects into the cell an extension equipped with a first lateral connection for the admission of a pumping steam flow, a second lateral connection connected to a pipe for admitting a fluid to be pumped and an axial diffuser for the discharge of said fluid which is shaped in convergent-divergent manner and fitted in the body behind the diffuser, a tube having an intake port for the flow of steam introduced into the body by the first lateral connection and having at its end facing the diffuser a nozzle for accelerating the steam in order to entrain the fluid to be pumped, the tube carrying the nozzle being extended in the body, at the opposite end to the diffuser, up to the outside of the wall of the cell by a shaft associated with means for controlling its displacement in the body in order to vary the relative position of the nozzle up to an end position where the tube abuts against the diffuser blocking the outflow of the fluid to be pumped, wherein the ejector body comprises downstream of the first connection with respect to the outflow direction of the steam in the tube a third lateral connection for the independent admission of a separate steam flow.

As a result the ejector operates in a normal manner ensuring the pumping of the fluid between the intake pipe and the outflow diffuser due to the entrainment effect produced by the steam supplied by the nozzle to the right of the diffuser. The position of the nozzle can be adjusted by acting on the position of the shaft which extends the tube. When a blockage occurs, either in the intake pipe or in the diffuser or beyond the latter the invention makes it possible to bring the tube carrying the nozzle into contact with the diffuser thus completely sealing in the manner of a needle valve the passage left free in normal operation between the intake pipe and the diffuser. In this sealing position the flow of steam introduced into the tube towards the nozzle is directly passed into the diffuser in order to ensure the unblocking of the latter or of the pipe located downstream. In the same way the separate steam flow supplied to the ejector body by the third connection is passed in the reverse direction and independently of the main flow in the nozzle into the intake pipe which also brings about the unblocking of the latter.

According to a first embodiment of the present ejector the shaft which extends the tube carrying the nozzle is mounted coaxially in the ejector body with an intermediate sleeve which on the outside of the cell is provided with a head carrying gaskets, which are respectively in contact with the inner surface of the ejector body and with a rod which terminates the shaft extending the tube, said rod having a threaded portion cooperating with a nut which is immobilised in translation relative to the sleeve head but is free in rotation in such a way that the control of said nut causes the displacement of the shaft in the sleeve and that of the nozzle relative to the diffuser. Advantageously a draw key is carried by the shaft and moves in a longitudinal port provided in the sleeve in such a way as to transform the rotational movement of the nut into a displacement of the shaft.

According to a second constructional variant the shaft which extends the tube carrying the nozzle has on the inside of the ejector body at least one larger diameter zone provided with sealing O-rings which bear against the inner surface of the body and at its opposite end a threaded rod which co-operates with a nut which is immobilised in translation but free in rotation relative to a fixed head mounted at the end of the ejector body in such a way that the rotation of the nut brings about the displacement of the shaft and the nozzle relative to the diffuser. In this variant the threaded rod advantageously has at its end outside the ejector body a transverse bore for the engagement of a pin which stops the rotation of the shaft.

BRIEF DESCRIPTION OF THE DRAWINGS

Other features of a pumping ejector according to the invention can be gathered from the following description of two embodiments, given in an indicative and non-limitative manner with reference to the attached drawings, wherein show.

DETAILED DESCRIPTION OF THE PREFERRED EMBODIMENTS

Figure 1:
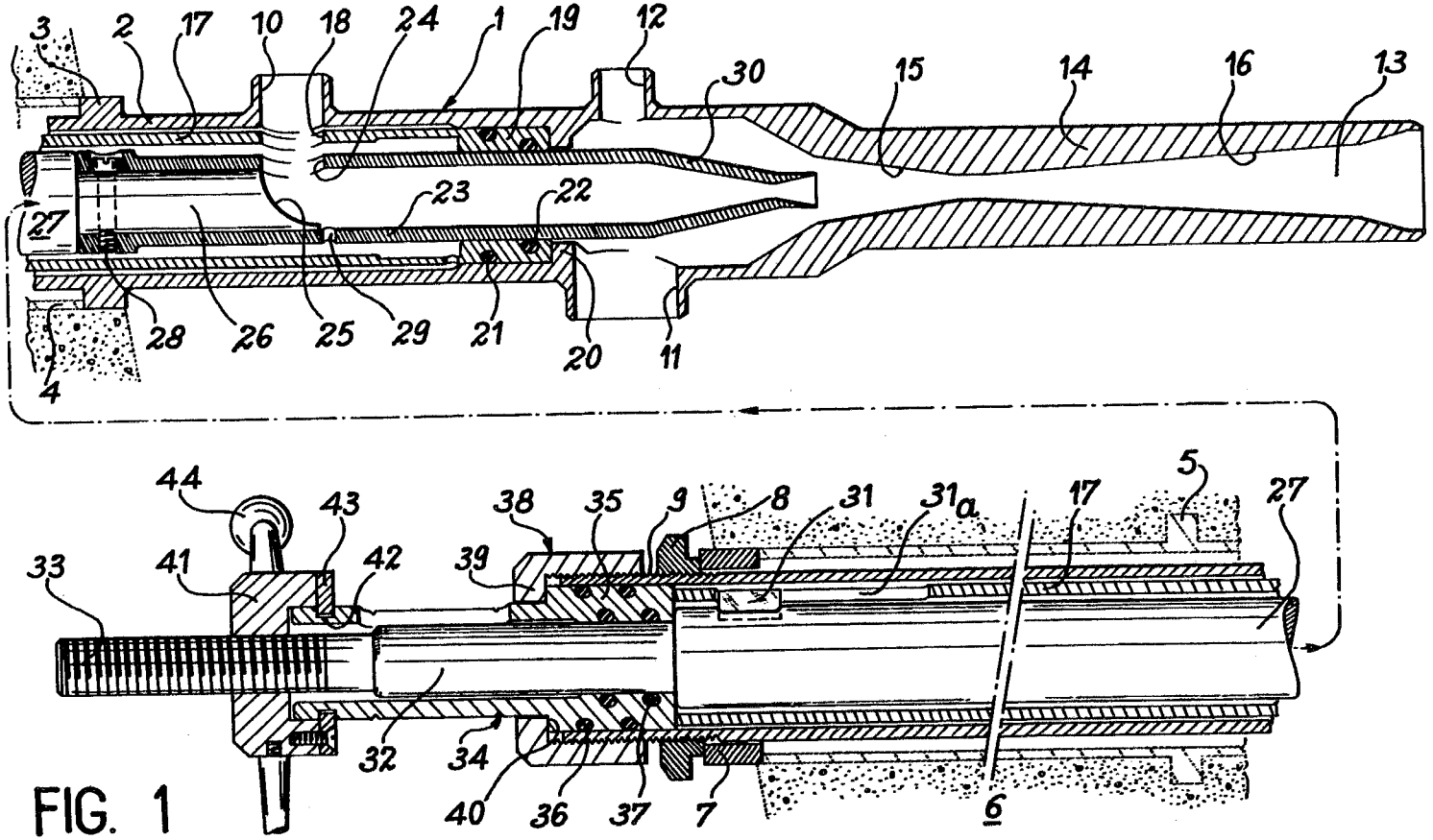
FIG. 1 an axial sectional view of a pumping ejector according to a first variant of the invention in which the tube carrying the nozzle for accelerating the entrainment steam is shown in the normal operating position.

In FIG. 1 reference numeral 1 designates overall the pumping ejector which substantially comprises a generally cylindrical elongated tubular body 2 having a flange 3 which bears against a retaining sleeve 4 embedded by anchoring shoulders 5 within wall 6 of a protective cell, which is not shown in detail and which in per se known manner serves for the manipulation of objects or radioactive products. The immobilisation of ejector body 2 against sleeve 4 is realised by means of a sealing and protective ring 7 mounted at the opposite end of flange 3, said ring being locked against sleeve 4 by means of a nut 8 screwed by force onto a threaded portion 9 provided at the end of body 2.

In that part of the ejector located within the protective cell body 2 has a first lateral connection 10 which makes it possible to supply by a not shown pipe which is conveniently fitted to said connection a steam flow necessary for the pumping into the ejector of a dangerous and in particular radioactive fluid liable to contain solid particles in suspension or having a very high viscosity. Further forwards and towards its end in the cell body 2 has a second connection 11 which serves to admit the fluid to be pumped, whilst a third connection 12, which is normally closed, is located in body 2 at the opposite end to the second connection 11 but in the axis of the latter. The fluid to be pumped introduced into body 2 by connection 11 is driven out of the latteer by the flow of steam produced through a discharge diffuser 13 positioned axially in the extension 14 of body 2, said diffuser being shaped internally in known convergent 15-divergent 16 manner.

In the present embodiment of the pumping ejector body 2 also has a cylindrical sleeve 17 which is mounted coaxially within it and which extends longitudinally over most of the length of body 2 and more particularly in its passage through wall 6 of the cell. Sleeve 17 has a lateral opening 18 which faces the connection 10 for the introduction of steam and which terminates at its end located within the protective cell of body 2 by an abutment 19 which is able to come into contact with an inner shoulder 20 provided in body 2. Abutment 19 carries O-rings 21, 22 which on the one hand bear against the inner surface of body 2 and on the other against a tube 23 mounted coaxially in sleeve 17, said tube 23 serving to carry the steam introduced in the apparatus. To this end tube 23 has a lateral opening 24 which faces the opening 18 of sleeve 17 and connection 10, said opening 24 being extended within the tube 23 by a suitably shaped deflector 25 fitted to the end of a finger 26 which extends a position control shaft 27. Shaft 27 is immobilised in tube 23 via a transverse screw 28. Finally a hole 29 is provided in the wall of tube 23 with respect to the end of deflector 25 for the discharge of condensates which could be located between tube 17 and body 2 following the stoppage of the ejector.

According to the invention at the end of tube 23 opposite to deflector 25 and facing diffuser 13 a nozzle 30 is provided which ensures the acceleration of the steam at the outlet from the tube where the latter serves as the entrainment agent for the fluid to be pumped, itself admitted into body 2 by connection 11 and is then forced back by diffuser 13. The postion of nozzle 30 can be adjusted within body 2 for which purpose the shaft 27 which extends tube 23 is provided with a key 31 which engages in a longitudinal port or groove 31*a* in the wall of coaxial sleeve 17. In addition shaft 27 is extended beyond the end of the sleeve by a rod 32 terminated by a threaded portion 33. Sleeve 17 is sealed at its corresponding end by a head 34 having a larger diameter portion 35 which engages in the end of body 2, sealing being ensured by joints 36, 37 which bear respectively against the ejector on the one hand and against the rod 32 on the other. The immobilisation of head 34 relative to the ejector body is obtained by means of a nut 38 having a bearing cover 39 which is applied against a shoulder 40 provided in said head, nut 38 being screwed to the end of body 2 on the thread 9 thereof.

Shaft 27 mounted within sleeve 17 co-operates by means of the threaded portion 33 of rod 32 with a control nut 41 which is immobilised in translation due to the engagement in a groove 42 of head 34 of a washer 43, whereby the rotation of nut 41 effected by levers 44 or similar means permitting by co-operation with thread 33 the displacement of shaft 27. The displacement of said shaft regulates the position of nozzle 20 relative to the discharge diffuser 13 by adjusting in normal operation the operating characteristics of the ejector.

Figure 2:
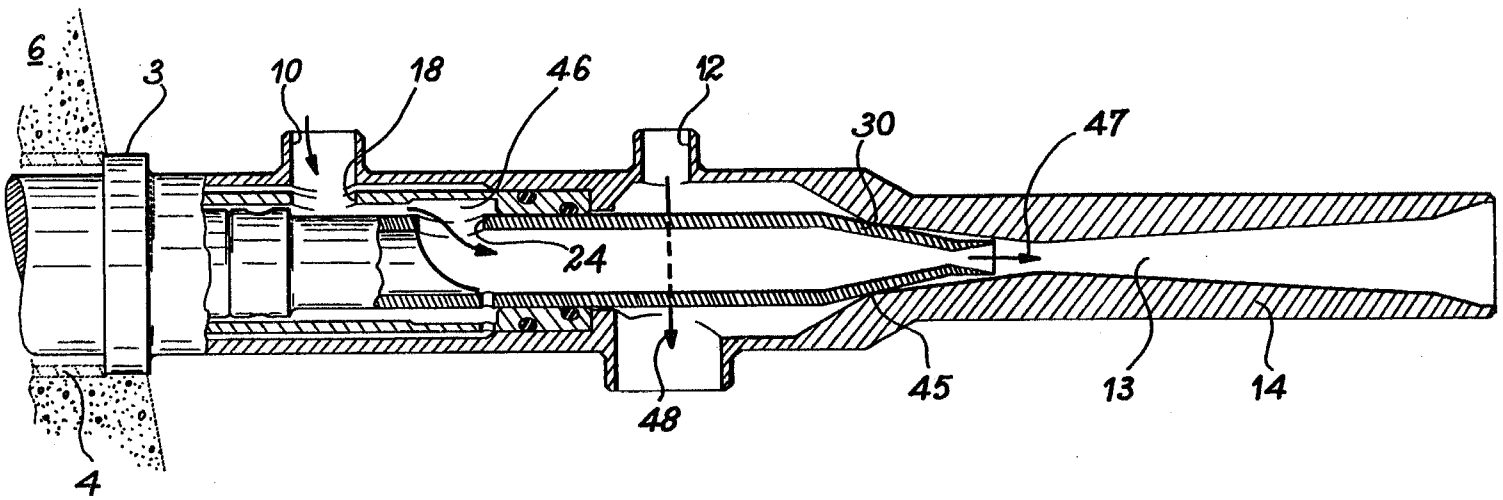
FIG. 2 a view of the front part of the ejector, illustrating more particularly the tube carrying the entrainment nozzle in a position where the latter seals the discharge diffuser.

In the position more particularly illustrated by FIG. 2 the displacement of nozzle 30 is effected until the latter abuts at 45 against the inner surface of diffuser 13, thus sealing the passage which is normally left free for the outflow of fluid between admission connection 11 and the diffuser outlet. Under these conditions the diffuser can be used without any other manipulation and more particularly without any intervention in the actual cell in order to bring about the unblocking or cleaning of the pipes, both upstream and downstream with respect to the outflow directin of the fluid to be pumped.

Thus, in the downstream direction the steam introduced into tube 23 by the first connection 10 can only escape via diffuser 14. With a suitable flow rate and pressure it brings about the cleaning of the pipe by scavenging residues or slag which have obstructed the outflow. In the upstream direction the same cleaning is brought about by admitting at the third connection 12 a separate steam flow which in countercurrent is forced back into the intake pipe via connection 11. In both cases the steam outflow direction is illustrated in FIG. 2 by arrows 47 and 48 respectively.

Figure 3:
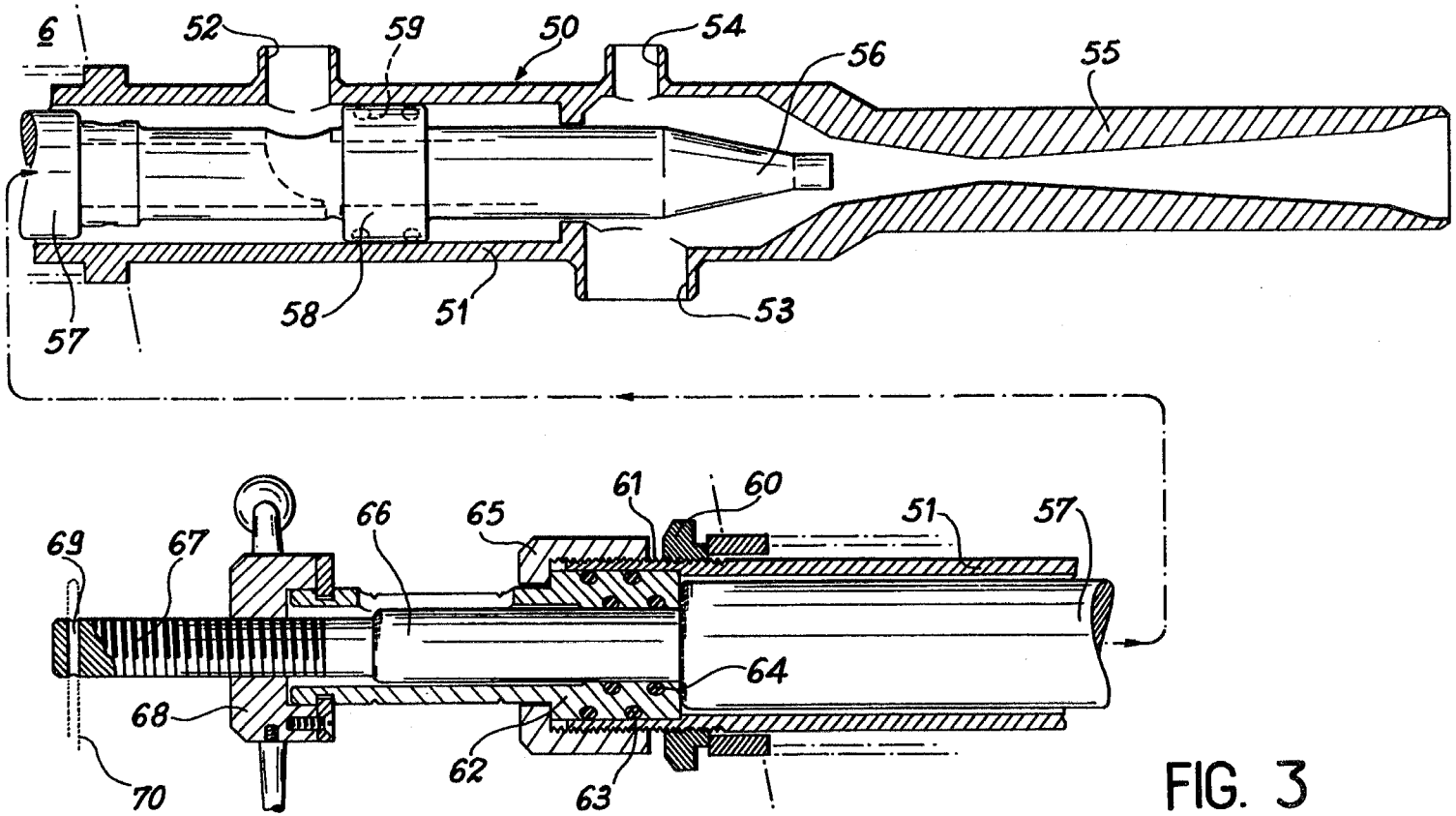
FIG. 3 an axial sectional view identical to FIG. 1, but relative to another variant of the pumping ejector in question.

FIG. 3 illustrates another constructional variant of the pumping ejector. This drawing incorporates the essential components of the first variant described hereinbefore, whilst the description is limited to the new features. Thus, it shows an ejector 50 having a cylindrical body 51 provided within the cell with a first admission connection 52 for an entrainment steam flow and two other connections 53, 54, the first being reserved for the admission of the fluid to be pumped and the second for the supply of a separate steam flow, whereby an axial outlet diffuser 55 permits the outflow as a function of the normal operation of the entrained fluid. In body 51 and facing diffuser 55 is provided a nozzle 56 for the acceleration of the entrainment steam and connected to an axial position control shaft 57.

In this constructional variant the ejector used is significantly simplified because it no longer has an intermediate sleeve, the sealing between the nozzle support and body 51 being effected at the level of a zone 58 of larger cross-section which in its outer surface carries gaskets 59 which rub directly against the inner surface of body 51.

At its opposite end body 51 is immobilised by a nut 60 screwed onto a threaded portion 61 with, as in the previous embodiment, the fitting of a head 62 equipped with joint 63, 64, said head being immobilised by a second nut 65. Shaft 57 is extended by a rod 66 terminated by a threaded portion 67 which engages with a captive nut 68 which permits, by its rotation, the longitudinal displacement of shaft 57 and consequently the variation of the position of nozzle 56 relative to diffuser 55. This arrangement requires shaft 57 to be free in translation but immobilised in rotation for which purpose it has at its end located beyond control nut 68 a transverse bore 69 permitting the engagement of a stop pin 70.

Thus, an ejector is obtained with axial regulation of the entrainment fluid nozzle which, whilst retaining the advantages of the known solutions, particularly the possibility of disassembling the said nozzle for repair or maintenance, permits by its displacement in the ejector body the variation of the ejector flow rate in normal operation, whilst maintaining the same admission and delivery pressures. Moreover in the maximum advance position of the nozzle the invention provides a sealing barrier between the intake and the supply, permitting only a steam flow towards one or other or both connection pipes for possible unblocking or cleaning. The moving forwards or backwards of the nozzle is always effected from the inactive zone outside the protective cell, which also constitutes an important advantage.

Obviously the invention is not limited to the embodiments more specifically described and represented hereinbefore. It covers all variants and it is obvious that the position control nut of the nozzle could be replaced by an equivalent system, for example a gear mechanism with automatic position regulation.

What is claimed is:

1. A pumping ejector comprising a fixed tubular ejector body traversing the wall of a protective cell, said body having in its part which projects into the cell an extension equipped with a first lateral connection for the admission of a pumping steam flow, a second lateral connection connected to a pipe for admitting a fluid to be pumped and an axial diffuser for the discharge of said fluid which is shaped in convergent-divergent manner and a tube fitted in the body behind the diffuser having an intake port for the flow of steam introduced into the body by the first lateral connection and having at its end facing the diffuser a nozzle for accelerating the steam in order to entrain the fluid to be pumped, the tube carrying the nozzle being extended in the body, at the opposite end to the diffuser, up to the outside of the wall of the cell by a shaft associated with means for controlling its displacement in the body in order to vary the relative position of the nozzle up to an end position where the tube abuts against the diffuser blocking the outflow of the fluid to be pumped, wherein the ejector body comprises downstream of the first connection with respect to the outflow direction of the stream in the tube a third lateral connection for the independent admission of a separate steam flow communicating with the second lateral connection whatever the position of the nozzle in the body, said third lateral connection admitting a separate cleaning stream flow when the nozzle occupies said end position.

2. A pumping ejector according to claim 1, wherein the shaft which extends the tube carrying the nozzle is mounted coaxially in the ejector body with an intermediate sleeve which on the outside of the cell is provided with a head carrying gaskets, which are respectively in contact with the inner surface of the ejector body and with a rod which terminates the shaft extending the tube, said rod having a threaded portion co-operating with a nut which is immobilised in translation relative to the sleeve head but is free in rotation in such a way that the control of said nut causes the displacement of the shaft in the sleeve and that of the nozzle relative to the diffuser.

3. A pumping ejector according to claim 1, wherein the shaft which extends the tube carrying the nozzle has on the inside of the ejector body at least one larger diameter zone provided with sealing O-rings which bear against the inner surface of the body and at its opposite end a threaded rod which co-operates with a nut which is immobilised in translation but free in rotation relative to a fixed head mounted at the end of the ejector body in such a way that the rotation of the nut brings about the displacement of the shaft and the nozzle relative to the diffuser.

4. A pumping ejector comprising a fixed tubular ejector body traversing the wall of a protective cell, said body having in its part which projects into the cell an extension equipped with a first lateral connection for the admission of a pumping steam flow, a second lateral connection connected to a pipe for admitting a fluid to be pumped and an axial diffuser for the discharge of said fluid which is shaped in convergent-divergent manner and a tube fitted in the body behind the diffuser having an intake port for the flow of steam introduced into the body by the first lateral connection and having at its end facing the diffuser a nozzle for accelerating the steam in order to entrain the fluid to be pumped, the tube carrying the nozzle being extended in the body, at the opposite end to the diffuser, up to the outside of the wall of the cell by a shaft associated with means for controlling its displacement in the body in order to vary the relative position of the nozzle up to an end position where the tube abuts against the diffuser blocking the outflow of the fluid to be pumped, wherein the ejector body comprises downstream of the first connection with respect to the outflow direction of the steam in the tube a third lateral connection for the independent admission of a separate steam flow communicating with the second lateral connection whatever the position of the nozzle in the body, said third lateral connection admitting a separate cleaning stream flow when the nozzle occupies said end position wherein the shaft which extends the tube carrying the nozzle is mounted coaxially in the ejector body with an intermediate sleeve which on the outside of the cell is provided with a head carrying gaskets, which are respectively in contact with the inner surface of the ejector body and with a rod which terminates the shaft extending the tube, said rod having a threaded portion co-operating with a nut which is immobilized in translation relative to the sleeve head but is free in rotation in such a way that the control of said nut causes the displacement of the shaft in the sleeve and that of the nozzle relative to the diffuser, wherein a draw key is carried by the shaft and moves in a longitudinal port provided in the sleeve so as to transform the rotational movement of the nut into a displacement of the shaft.

5. A pumping ejector comprising a fixed tubular ejector body traversing the wall of a protective cell, said body having in its part which projects into the cell an extension equipped with a first lateral connection for the admission of a pumping steam flow, a second lateral connection connected to a pipe for admitting a fluid to be pumped and an axial diffuser for the discharge of said fluid which is shaped in convergent-divergent manner and a tube fitted in the body behind the diffuser having an intake port for the flow of steam introduced into the body by the first lateral connection and having at its end facing the diffuser a nozzle for accelerating the steam in order to entrain the fluid to be pumped, the tube carrying the nozzle being extended in the body, at the opposite end to the diffuser, up to the outside of the wall of the cell by a shaft associated with means for controlling its displacement in the body in order to vary the relative position of the nozzle up to an end position where the tube abuts against the diffuser blocking the outflow of the fluid to be pumped, wherein the ejector body comprises downstream of the first connection with respect to the outflow direction of the steam in the tube a third lateral connection for the independent admission of a separate steam flow communicating with the second lateral connection what ever the position of the nozzle in the body, said third lateral connection admitting a separate cleaning stream flow when the nozzle occupies said end position, wherein the shaft which extends the tube carrying the nozzle has on the inside of the ejector body at least one larger diameter zone provided with sealing 0-rings which bear against the inner surface of the body and at its opposite end a threaded rod which co-operates with a nut which is immobilized in translation but free in rotation relative to a fixed head mounted at the end of the ejector body in such a way that the rotation of the nut brings about the displacement of the shaft and the nozzle relative to the diffuser, wherein the threaded rod has at its end outside the ejector body a transverse bore for the engagement of a pin which stops the rotation of the shaft.

* * * * *